US007192258B2

(12) United States Patent
Kuo et al.

(10) Patent No.: US 7,192,258 B2
(45) Date of Patent: Mar. 20, 2007

(54) AXIAL FLOW TYPE COOLING FAN WITH SHROUDED BLADES

(75) Inventors: Chii-Ron Kuo, Hsinchu (TW); Chia-Yang Chang, Tu-Cheng (TW); Tzeng Wuu Wey, Hsinchu Hsien (TW)

(73) Assignee: Industrial Technology Research Institute, Hsinchu (TW)

( * ) Notice: Subject to any disclaimer, the term of this patent is extended or adjusted under 35 U.S.C. 154(b) by 493 days.

(21) Appl. No.: 10/733,108

(22) Filed: Dec. 10, 2003

(65) Prior Publication Data

US 2005/0089411 A1 Apr. 28, 2005

(30) Foreign Application Priority Data

Oct. 22, 2003 (TW) ..... 92129360 A

(51) Int. Cl.
*F04B 17/00* (2006.01)

(52) U.S. Cl. ..... 417/356

(58) Field of Classification Search ..... 417/355, 417/356, 423.1–423.7; 416/189; 310/63, 310/62, 268, 156.32
See application file for complete search history.

(56) References Cited

U.S. PATENT DOCUMENTS 6,194,798 B1 * 2/2001 Lopatinsky ..... 310/63

FOREIGN PATENT DOCUMENTS

JP 07205897 A * 8/1995

* cited by examiner

*Primary Examiner*—Ehud Gartenberg
*Assistant Examiner*—Vikansha Dwivedi
(74) *Attorney, Agent, or Firm*—Quintero Law Office

(57) ABSTRACT

An axial flow type cooling fan, comprising an upper casing, a lower casing, a rotor assembly, and a driving unit. The lower casing and the upper casing enclose an inner space. The rotor assembly is housed in the inner space and performs a rotational movement. The rotor assembly further comprises a plurality of blades, attached to a central shaft and having a peripheral ring, from which a peripheral rim extends outward. The driving unit has electric coils on the upper or lower casings and permanent magnets on the peripheral rim, causing the rotational movement of said rotor assembly. By the arrangement of these structural parts, an increased area of air flow and consequently increased air flow are attained, while drag and noise are reduced.

11 Claims, 3 Drawing Sheets

AXIAL FLOW TYPE COOLING FAN WITH SHROUDED BLADES

FIELD OF THE INVENTION

The present invention relates to an axial flow type cooling fan with shrouded blades, characterized by: (1) having a driving unit which comprises electric coils on a casing and permanent magnets on a peripheral rim of a rotor assembly, (2) having the electric coils placed either on an upper casing or a lower casing or both upper and lower casings, (3) the rotor assembly having a central shaft, a plurality of blades and a peripheral ring, which form an integral body. By the arrangement of its structural parts, the present invention offers (1) an increased area of air flow and consequently increased air flow, no escaping of air from blade edges. (2) increased rotational stability at reduced noise, and (3) implementability of a flat shape, making the present invention suitable for notebook computers.

DESCRIPTION OF RELATED ART

Microprocessors used in a computer are undergoing a fast development to ever greater performance, accompanied by an ever increasing demand on effective cooling. For better cooling, the following approaches have been taken:

(1) Change of material, like substituting copper, silver, gold.
(2) Increasing heat-radiating area.
(3) Reducing weight of fins.
(4) Increased air flow.
(5) Reduced drag for higher air flow pressure.

Among these measures, (1), (2) and (3) are improvements on heat sinks, while (4) and (5) improve ventilators. However, due to limitations of structure, always having a motor with a shaft, increasing air flow and reducing drag is fraught with difficulties.

A conventional cooling fan has a rotor, mounted on a rotationally symmetric stator which carries an electric coil. Sending a varying electric current through the coil causes a varying magnetic field between the stator and a rotor, which consequently rotates, controlled by regulating the electric current through the coil. The rotor is mounted using a sleeve bearing, a ball bearing or a magnetic bearing. Direct driving of the shaft of the rotor results in the following problems: (1) Air flow is achieved only in a narrow area. (2) Supports of the driving unit in the air flow result in vortex shedding and noise. (3) Large quantities of air escape from edges of ventilator blades.

A cooling fan, disclosed in Taiwan patent no. 528178, comprises, as shown in FIG. 3, an upper casing 1, forming a stator, a lower plate 2, and a set of blades 3, mounted inside the stator. The upper casing 1 has a central hole, from which a circular upper rim extends downward. Similarly, the lower plate 2 has a central hole, from which a circular lower rim extends upward. The lower rim has an outer diameter that is smaller than the inner diameter of the upper rim and carries on an outer periphery at least two permanent magnets 4. Coils 5 are wound on the upper casing 1. The set of blades 3 has an outer diameter that is smaller than the inner diameter of the lower rim and has a shaft 3*a* and a plurality of blades 3*b*. This design of a cooling fan is disadvantageous for a flatter shape.

SUMMARY OF THE INVENTION

It is therefore an object of the present invention to provide an axial flow type cooling fan with an increased area of air flow, resulting in increased air flow, better rotational stability and allowing for a flatter shape, so that a more compact shape, lower noise, longer lifetime and more versatility for use in small devices like pen computers are achieved. The present invention comprises: an upper casing and a lower casing, enclosing an inner space; a rotor assembly in the inner space, having a central shaft, a plurality of blades and a peripheral ring, which together form an integral body; and a driving unit, driving a rotational movement of the rotor assembly. The driving unit further comprises electric coils on the upper or lower casings and permanent magnets on a peripheral rim of the rotor assembly. By this arrangement, increased air flow at better rotational stability and reduced drag is achieved.

Another object of the present invention is to provide an axial flow type cooling fan with better rotational stability.

A further object of the present invention is to provide an axial flow type cooling fan which prevents air from escaping from far edges of blades.

A further object of the present invention is to provide an axial flow type cooling fan which allows for a flat design.

The present invention can be more fully understood by reference to the following description and accompanying drawings.

DETAILED DESCRIPTION OF THE PREFERRED EMBODIMENT

As shown in FIGS. 1 and 2, the axial flow type cooling fan of the present invention comprises: an upper casing 10; a lower casing 20; a rotor assembly 30; and a driving unit 40, driving a rotational movement of the rotor assembly 30.

The upper and lower casings 10, 20 are fastened to each other by bolts or hooks, forming a complete enclosure for the rotor assembly 30 and the driving unit 40.

The rotor assembly 30 has a central shaft 32, carrying a plurality of blades 33. The blades 33 have outer edges that carry a peripheral ring 34. A peripheral rim 35 extends from the peripheral ring 34 outward. Permanent magnets 31 are attached to the peripheral rim 35.

The driving unit 40 drives the rotating movement of the rotor assembly 30 with respect to the upper and lower casings 10, 20. The driving unit 40 has coils 41, which are placed facing the permanent magnets 31 of the rotor assembly 30.

When an electric current passes through the coils 41 of the driving unit 40, a magnetic field between the coils 41 and the permanent magnets 31 on the peripheral rim 35 of the rotor assembly 30 results. By regulating the electric current through the coils 41, the rotating movement of the rotor assembly 30 is controlled.

According to operative needs, the coils 41 are either placed on the upper casing 10 or the lower casing 20 or both the upper casing 10 and the lower casing 20.

For stability of the rotational movement, a seat 21 on the upper casing 10 and the lower casing 20 supports and guides the rotor assembly 30 during the rotational movement thereof.

The main characteristics of the present invention are as follows:

(1) The driving unit 40 consists of the coils 41 on the upper casing 10 and the permanent magnets 31 on the peripheral rim 35 of the rotor assembly 30.
(2) The permanent magnets 31 are inserted in the peripheral rim 35 of the rotor assembly 30.
(3) The shaft 32, the blades 33 and the peripheral ring 34 of the rotor assembly 30 form an integral body.

By the setup described above, the present invention has the following capabilities:

(1) The area of air flow is enlarged, increasing air flow and reducing drag.

(2) Driving the rotor assembly 30 by the driving unit 40 provides for a more efficient rotational movement, with increased stability and less noise.

(3) By integrating the blades 33 and the peripheral ring 34 of the rotor assembly 30 into a single body, no air leaks away from the edges of the blades 33.

(4) The driving unit 40 allows for a flat shape of the cooling fan.

While the invention has been described with reference to a preferred embodiment thereof, it is to be understood that modifications or variations may be easily made without departing from the spirit of this invention which is defined by the appended claims.

Figure 1:
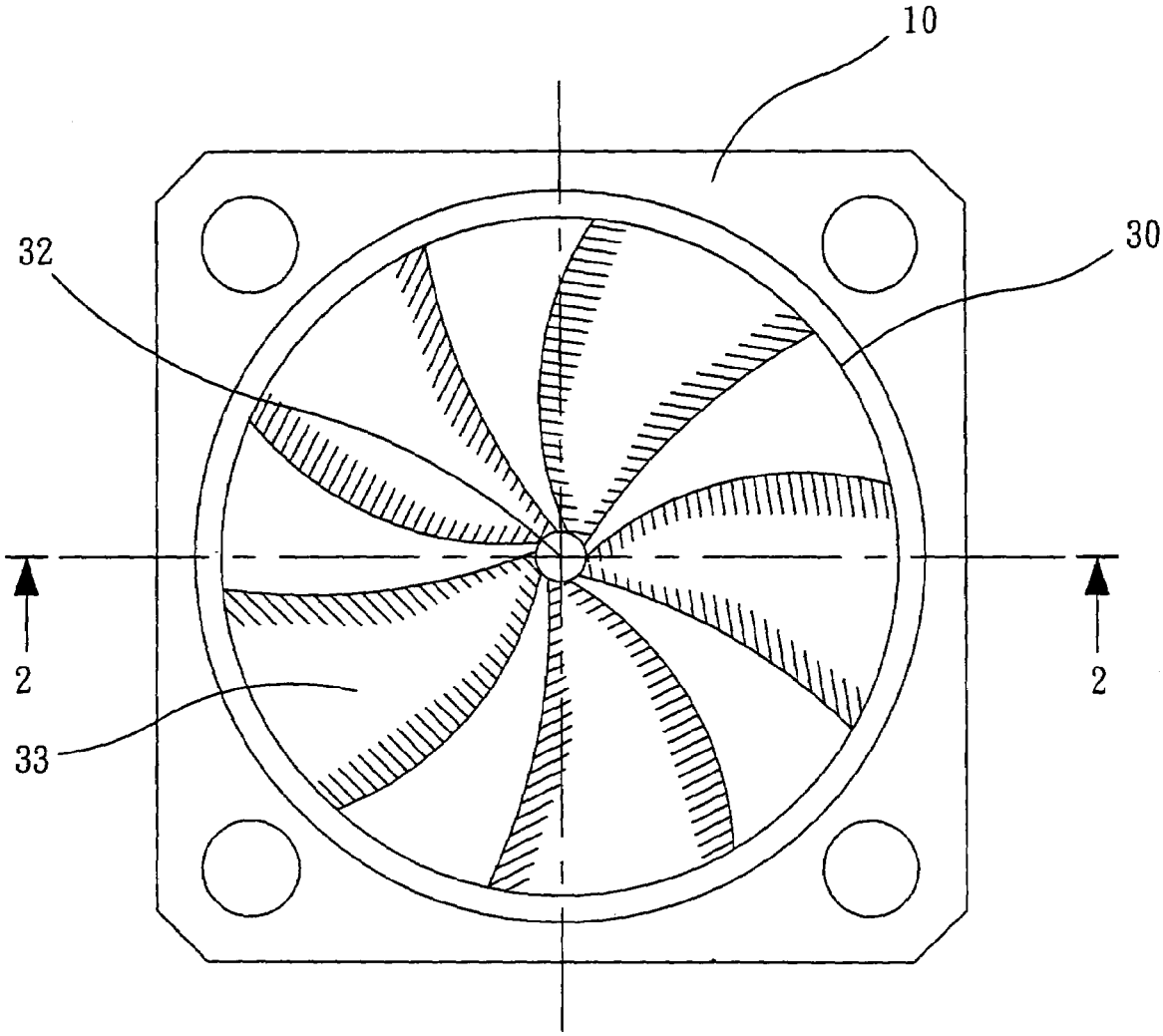
FIG. 1 is a top view of the axial flow type cooling fan of the present invention.
Figure 2:
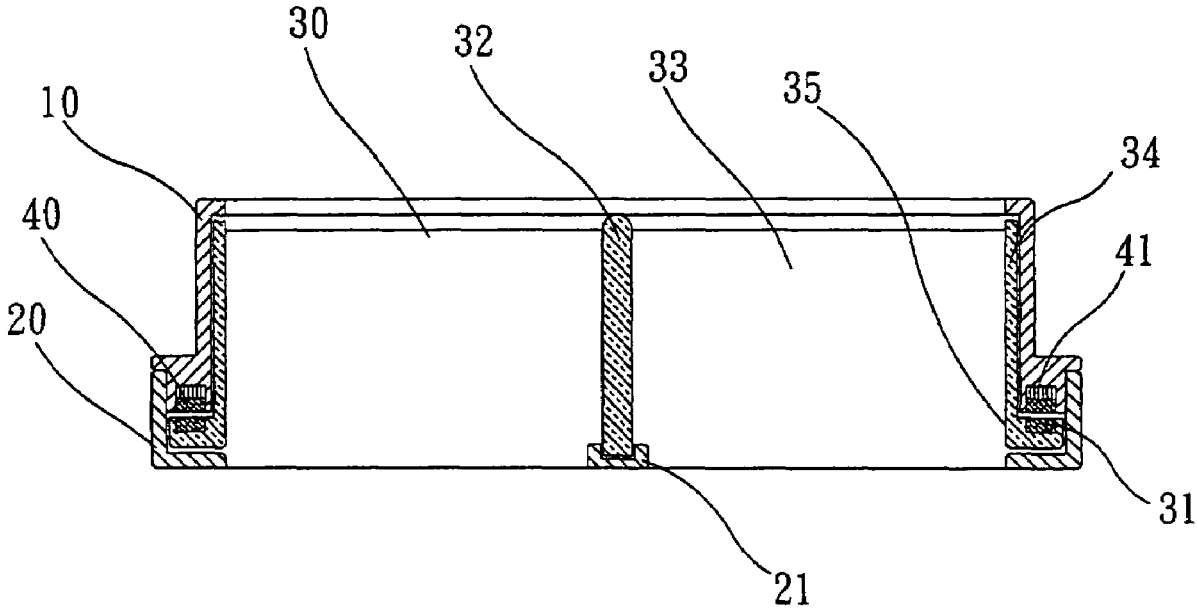
FIG. 2 is a cross-sectional view of the axial flow type cooling fan of the present invention, taken along line 2—2 of FIG. 1.
Figure 3:
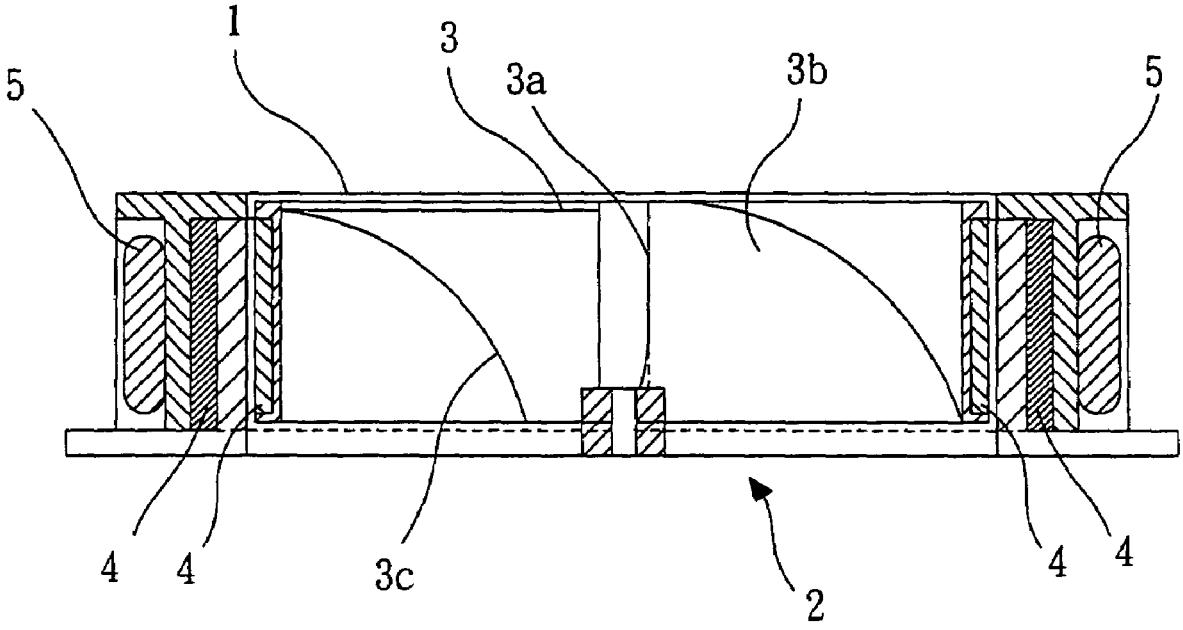
FIG 3(PRIOR ART)
FIG. 3 is a cross-sectional view of a conventional axial flow type cooling fan.

The invention claimed is:

1. An axial flow type cooling fan, comprising:

an upper casing;

a lower casing, attached to said upper casing and together with said upper casing enclosing an inner space;

a rotor assembly, housed in said inner space and performing a rotational movement, the rotor assembly comprising a plurality of blades attached to a central shaft and a peripheral ring encircling the blades, wherein the peripheral ring has a peripheral rim extending outward therefrom; and a driving unit, comprising permanent magnets disposed on said peripheral rim and electric coils disposed on said upper or lower casings to face said permanent magnets, causing said rotational movement of said rotor assembly.

2. The axial flow type cooling fan according to claim 1, wherein said electric coils of said driving unit are mounted on said upper casing only.

3. The axial flow type cooling fan according to claim 1, further comprising a seat in said inner space for supporting and guiding said rotor assembly.

4. The axial flow type cooling fan according to claim 1, wherein said permanent magnets are inserted in said peripheral rim of said rotor assembly.

5. The axial flow type cooling fan according to claim 1, wherein said blades, said central shaft and said peripheral ring of said rotor assembly form an integral body.

6. The axial flow type cooling fan according to claim 1, wherein said peripheral rim is perpendicular to said center shaft.

7. The axial flow type cooling fan according to claim 6, wherein said coils are disposed on said upper casing above said permanent magnets so as to define an axis parallel to said central shaft.

8. The axial flow type cooling fan according to claim 1, wherein said coils are disposed on said upper casing above said permanent magnets so as to define an axis parallel to said central shaft.

9. The axial flow type cooling fan according to claim 1, wherein said electric coils of said driving unit are mounted on said lower casing only.

10. The axial flow type cooling fan according to claim 1, wherein said electric coils of said driving unit are mounted on both said upper casing and said lower casing.

11. The axial flow type cooling fan according to claim 1, wherein said electrical coils and said permanent magnets are arranged axially relative to said central shaft.

* * * * *